United States Patent [19]

Grittmann

[11] Patent Number: 4,572,390

[45] Date of Patent: Feb. 25, 1986

[54] BUNG HOLE CLOSURE FOR CANS

[76] Inventor: Günter Grittmann, Ringstrasse 6, 7519 Eppingen-Mühlbach, Fed. Rep. of Germany

[21] Appl. No.: 674,034

[22] Filed: Nov. 23, 1984

[30] Foreign Application Priority Data

Dec. 16, 1983 [DE] Fed. Rep. of Germany ..... 3345619

[51] Int. Cl.[4] ..... B65D 39/04

[52] U.S. Cl. ..... 217/106; 215/364; 217/98; 217/111; 220/266; 220/307

[58] Field of Search ..... 217/110, 111, 113, 98, 217/106; 220/307, DIG. 19, 266; 215/264

[56] References Cited

U.S. PATENT DOCUMENTS

| | | | |
|---|---|---|---|
| 573,239 | 12/1896 | Rockwell | 215/364 |
| 1,966,384 | 7/1934 | Gabel et al. | 217/111 |
| 3,802,027 | 4/1974 | Mueller | 217/111 X |
| 3,811,596 | 5/1974 | Wilson | 215/364 X |
| 3,945,529 | 3/1976 | Haag | 220/307 |

FOREIGN PATENT DOCUMENTS

| | | | |
|---|---|---|---|
| 94449 | 12/1962 | Denmark | 217/111 |
| 2160228 | 3/1973 | Fed. Rep. of Germany | 217/110 |
| 413941 | 8/1910 | France | 217/113 |

*Primary Examiner*—Allan N. Shoap
*Attorney, Agent, or Firm*—Kurt Kelman

[57] ABSTRACT

A bung hole closure for cans is described, in which a liquid is stored under pressure or without pressure and from which it is removed under pressure by means of a tap fitting. It comprises a plug-like soft portion bored thru axially having at least one sealing portion in the inside bore, a projection serving for support on the rim region of the can lid surrounding the can opening and a seal seat for the rim of the can opening provided underneath the projection. This soft portion is surrounded by a reinforcing hard portion in the form of a sleeve, which has a projection which is embedded in the projection of the soft portion. The jacket of the sleeve is perforated and has smooth continuous webs and, arranged between these webs, conically outward protruding catches which can be pushed into the material of the soft portion.

4 Claims, 7 Drawing Figures

BUNG HOLE CLOSURE FOR CANS

The invention relates to a bung hole closure for cans, in which a liquid is stored under pressure or without pressure and from which it is removed under pressure by means of a tap fitting, comprising a plug-like bung bush defining an axial bore having at least one sealing portion, a projection serving for support on the rim region of the can lid surrounding the can opening and a seal seat for the rim of the can opening provided underneath the projection.

Various embodiments of bung hole closures of this type are known. They are broached by means of a small tap fitting in order to tap the liquid under pressure. The bung hole closure must, on the one hand, ensure that the can with isobarometrically filled liquid is sealed absolutely tight and, on the other hand, when broached by the extractor spear introduced, the tap fitting is sealed off in such a way that the pressure conditions existing and arising in the can are in no way impaired. In order to ensure a tight fit in the can opening, at the joint between the projection and the outer wall of the known bung bushes there is an annular recess, preferably provided with a sealing lip, into which the edge of the rim of the bung hole engages. This means that a certain weakness may occur at this point in the wall of the bung bush. The seal with the extractor spear of the tap fitting is accomplished by means of two or three bead rings in the inside bore of the bung bush. An adequate elasticity of the bung bush is necessary for this sealing process and the known bung bushes therefore consist of a rubber-like, relatively soft material, which must have a certain Shore hardness. The tightness of the seal suffers if the Shore hardness is too high.

One of the disadvantages of the known bung hole closures is that optimum sealing cannot be achieved. Compromises therefore have to be made which, however, in the final analysis do not produce satisfactory results. For example, the bung bush can never be introduced axially and in one operation. The counteracting rubber material in the cone region of the bung bush has to be displaced. Fitting of the bung hole closure is only possible by exerting considerable force alternately on either side of the rim, for example by means of several hammer blows. A hammer blow on freshly filled beer is highly undesirable, in particular because of the decarbonization which immediately starts. The projection, which rests on the rim region of the can lid surrounding the can opening, consists of the same soft material as the sealing portion. If such a bung bush is driven into the can opening by a hammer, it is possible that the soft projection will give way and the entire bung bush be pushed into the can. When hammering in, the cone of the bung bush must yield so that the opening rim can catch in the recess on the outer wall of the bung bush. However, the force of the hammer blow can also deform the can lid. Furthermore, when broaching, the rubber bung bush can be drawn in if the extractor spear, generally made of hard plastic, is not moistened before broaching. The resistance of the bead rings and of the sealing cap embedded in the bead rings and to be pushed out with which the extractor spear is opposed is often so great that the bung bush is drawn into the can with the extractor spear. Finally, the opening of the bung hole can also be warped by the pressure in the can rising due to heating, for example in summer, when the filled can is stored without cooling. A warped can opening deforms the soft bung hole closure, however, so that the tightness suffers.

The object of the invention is to create a bung hole closure of the type mentioned at the start in which the bung bush on the one hand has adequate strength and on the other hand ensures perfect sealing, thereby eliminating the disadvantages of the known closures and making automatic closure of the cans possible, even by machine, and in which beer in the can is not impaired by hammer blows directly after filling.

This object is achieved by providing a soft portion forming the bung bush and a hard sleeve portion reinforcing the soft portion and, surrounding it like a cage, a projection of the hard sleeve portion is embedded in a projection of the soft portion, on the free rim of the sleeve. The sleeve is perforated in such a way as to produce continuous webs extending from a ring of the sleeve opposite the projection to an upper ring of the sleeve and snap catches extend between the webs from the ring, and end underneath the outer ring. The catches conically protrude outwards, the webs are completely embedded in the material of the soft portion of the bung bush while making the catches, on the other hand, so that they can be pushed into the material.

All the disadvantages of the known bung bushes are eliminated by such a bung hole closure. By the combination of the soft portion ensuring sealing with a hard portion, pushing in of the bung bush is avoided both in fitting it in a can opening and in broaching. Due to the reinforcement of hard material, the projection is so solid that it cannot deform. Furthermore, the hard portion surrounding the bung bush lends it such a rigidity that no warping of the can opening, and thus deformation of the bung bush, is to be feared. In addition, fitting is made easier. Thanks to the smooth outer wall of the sleeve portions and the spring effect of the catches, the bung hole closure slips more easily into the can opening when inserted. As soon as the projection of the bung bush rests on the can lid, the catches which have been pushed inwards by the rim of the can opening during introduction spread out again and snap over the rim of the can opening. The bung hole closure is thus permanently held. Production of the bung hole closure according to the invention is extremely simple as it can be produced by injection molding in a single operation.

The invention is explained in more detail below with reference to now preferred embodiments shown in the drawings, in which FIG. 1 shows a side view of a bung hole closure according to the invention;

The bung hole closure comprises a soft portion I and a hard portion II.

Figure 5:
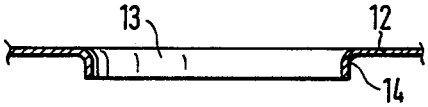
FIG. 5 shows a sectional view of a can lid with can opening.

The soft portion I is the sealing bung bush having a projection 1 and sealing portions, such as bead rings 3 in the inside bore. Underneath the projection 1 there is a surface 4 encircling the jacket of the bung bush, which surface, in a preferred embodiment of the bung hole closure according to the invention, assumes the function of providing the seal between the bung bush and the rim 14 of the can opening 13 in the can lid 12 (FIG. 5). This achieves a particularly good surface seal, which ensures 100% tightness even in the case of cans not under pressure.

Figure 2:
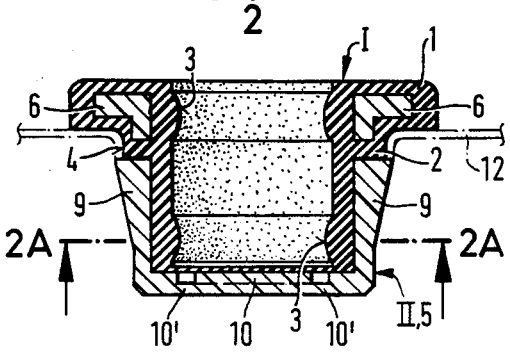
FIG. 2 shows a longitudinal sectional view of a bung hole closure along line 2—2 of FIG. 1.
Figure 3:
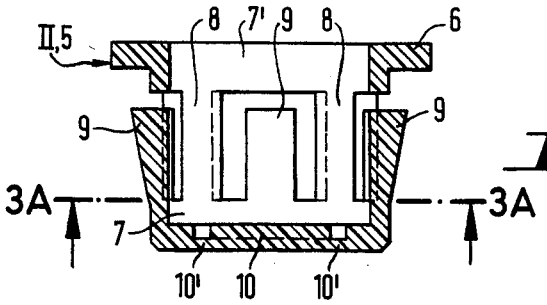
FIG. 3 shows a longitudinal sectional view of a hard portion of a bung hole closure.
Figure 3A:
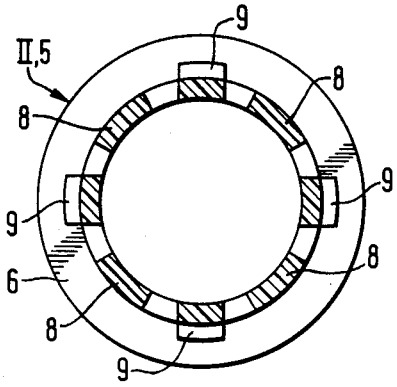
FIG. 3A shows a sectional view in the direction of arrows 3A—3A in FIG. 3.
Figure 4:
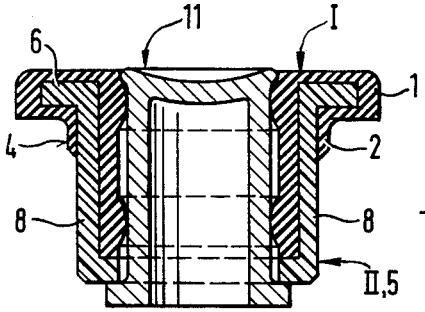
FIG. 4 shows a longitudinal sectional view in the direction of arrows 4—4 in FIG. 2A of a second embodiment.

The hard portion II reinforces the soft portion I responsible for the seal. It comprises a sleeve 5 which has a projection 6 on one rim. This projection 6 is embedded in the projection 1 of the soft portion I (FIGS. 2 and 4). The jacket of the sleeve 5 is perforated in the axial direction. The rim of the sleeve 5 opposite the projection 6 is finished off by a ring 7. Extending from the rim of the ring 7 are webs 8, which are joined to an upper rim 7' of the sleeve 5. Catches 9, likewise extending from the ring 7, are provided between webs 8 and are designed to protrude conically outwards and end underneath the ring 7' of the sleeve 5 (FIG. 3). They form the catch of the bung hole closure in the can opening 13.

Figure 2A:
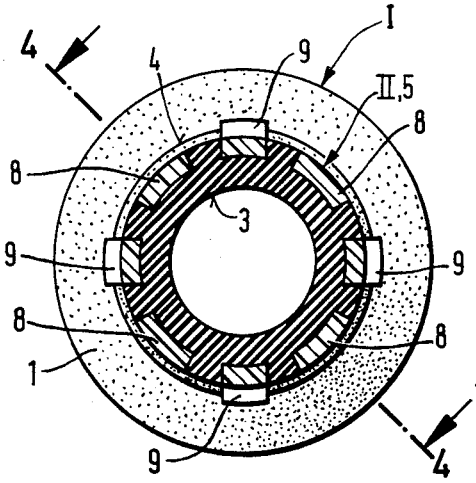
FIG. 2A shows a side view in the direction of the arrows 2A—2A in FIG. 2.

The assembled bung hole closure can be seen in FIGS. 2, 2A and 4. The sleeve 5 of the hard portion II surrounds the body of the soft portion I forming the bung bush, the webs 8 being embedded in the soft portion I and the outsides of the webs 8 lying flush with the material of the soft portion I. The outside surfaces of the catches 9, which extend conically outwards, protrude from the surface 4 underneath the projection 1 of the soft portion I. In this way recess is produced underneath the projection 1, which is engaged by rim 14 of the can opening 13. This recess is delimited by the surface 4.

The projection 6 of the sleeve 5 is embedded in the projection 1 of the soft portion I and is completely surrounded thereby. The free upper side of each catch 9 is almost covered by the material of the soft portion I, so that there is no weak or untight point produced here and the ring 2 having the surface 4 (FIG. 2) and made of material of the soft portion I does not have any interruption.

When pushing the bung hole closure into the can opening 13, the catches 9 are pushed inwards into the material of the bung bush. They snap out again as soon as the projection 1 of the closure rests on the can lid 12 and the rim 14 of the can opening 13 clears the upper edges of the catches 9 (FIG. 2).

Two embodiments for closure of the bore of the bung bush are illustrated herein.

Figure 1:
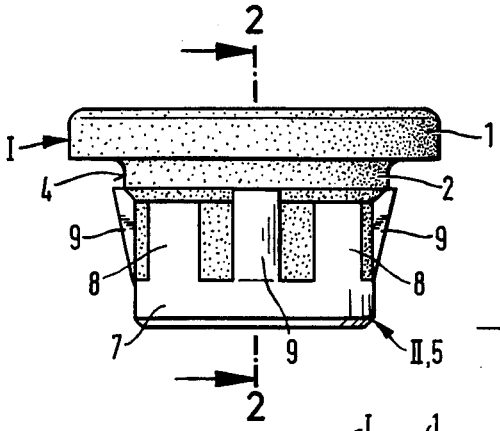

The opening of the sleeve 5 of the hard portion II opposite the projection 6 can be closed off by a plate 10 formed on the free rim of the ring (FIGS. 1 to 3). This plate 10 must be penetrated by the extractor spear of the tap fitting and predetermined braking points 10' are provided in the plate for this purpose.

On the other hand, the sleeve 5 can be open at both ends. In this case, a sealing and covering cap 11 taking up the entire bore of the bung bush is provided. (FIG. 4).

Finally, the bottom of the soft portion I can be closed off by a penetrable plate or membrane (not shown) which ensures the tightness of the bung hole closure. The plate or membrane can be formed onto the bottom rim of the soft portion I.

What is claimed is:

1. A two-part closure for a bung hole in a lid of a can in which a liquid is stored and whence the liquid may be tapped under pressure, the lid having a smooth rim defining the bung hole, which comprises (a) a soft, plug-like tubular bung bush defining an axial bore for insertion into the bung hole and having (1) a transverse sealing portion projecting across the bottom of the bore, (2) a radially outwardly extending annular projection at an outer end of the bung bush and adapted to support the inserted bung bush on the lid and including a smooth seal seat facing axially downwardly from the projection for sealing engagement with the smooth rim when the bung bush is inserted into the bung hole, and (b) a hard, cage-like sleeve surrounding and reinforcing the soft bung bush, the cage-like sleeve including (1) respective rings at an outer end and an inner end of the sleeve, (2) a projection extending radially outwardly from the ring at the outer end and embedded in the annular projection of the soft bung bush for reinforcement thereof, (3) axially extending webs connecting the rings and defining axially extending perforations therebetween, the webs being embedded completely in the soft bung bush, and (4) snap catches extending axially and radially outward from the ring at the inner end to free ends of the catches located below the ring at the outer end and below the smooth seal seat, the catches protruding conically in their extension so that they tapen axially and radially outwardly as they extend toward said outer end and being adapted to be pushed radially inwardly by the rim when the closure is inserted in the bung hole and to snap back to protrude below the rim after the closure has been inserted.

2. The two-part closure of claim 1, further comprising a plate closing off the bung bush at an inner end thereof, the plate being adapted to be penetrated by a liquid tapping tool.

3. The bung hole closure of claim 2, wherein the plate defines weakened breaking points and is positioned on a rim of the ring at the inner end of the hard cage-like sleeve.

4. The bung hole closure of claim 1, further comprising a sealing cap removably mounted in an open outer end of the bung bush.

* * * * *